US007125020B2

(12) United States Patent
LeClair, Jr. et al.

(10) Patent No.: US 7,125,020 B2
(45) Date of Patent: Oct. 24, 2006

(54) VENTED HIGH PRESSURE SHAFT SEAL

(75) Inventors: James M. LeClair, Jr., Shakopee, MN (US); Jarett D. Millar, Minneapolis, MN (US); Andrew T. Miller, Eagan, MN (US)

(73) Assignee: Eaton Corporation, Cleveland, OH (US)

( * ) Notice: Subject to any disclaimer, the term of this patent is extended or adjusted under 35 U.S.C. 154(b) by 41 days.

(21) Appl. No.: 10/777,239

(22) Filed: Feb. 12, 2004

(65) Prior Publication Data

US 2004/0160013 A1 Aug. 19, 2004

Related U.S. Application Data

(63) Continuation-in-part of application No. 10/167,218, filed on Jun. 11, 2002, now abandoned.

(51) Int. Cl.
*F04C 15/00* (2006.01)
*F16J 15/32* (2006.01)

(52) U.S. Cl. ..... 277/552; 277/549; 277/562; 277/563; 277/572

(58) Field of Classification Search ..... 277/549, 277/552, 562, 563, 572
See application file for complete search history.

(56) References Cited

U.S. PATENT DOCUMENTS 3,360,272 A * 12/1967 Blom et al. ..... 277/348
3,743,303 A * 7/1973 Pope ..... 277/422
3,829,104 A * 8/1974 Green ..... 277/552
3,934,311 A * 1/1976 Thompson ..... 452/13
4,171,938 A * 10/1979 Pahl ..... 418/61.3
4,183,540 A * 1/1980 Hytonen ..... 277/388
4,362,479 A * 12/1982 Pahl ..... 418/61.3
4,451,217 A * 5/1984 White ..... 418/69
4,491,332 A * 1/1985 Zumbusch ..... 277/558
4,741,681 A * 5/1988 Bernstrom ..... 418/61.3
4,762,479 A * 8/1988 Uppal ..... 418/61.3
5,199,718 A * 4/1993 Niemiec ..... 277/552
5,385,351 A * 1/1995 White ..... 277/572
5,558,341 A * 9/1996 McNickle et al. ..... 277/400
5,984,315 A * 11/1999 Burkhardt et al. ..... 277/500
6,293,558 B1 * 9/2001 Crapart ..... 277/552

* cited by examiner

*Primary Examiner*—Katherine Mitchell
(74) *Attorney, Agent, or Firm*—Jarett D. Millar; K. J. Kasper

(57) ABSTRACT

A rotary fluid pressure device (11) having a housing (13,31), inlet and outlet ports (21,23), a gerotor gear set (15), a valve member (51) and an input-output shaft (49). A seal assembly (73) is disposed radially between the shaft (49) and the housing (31). The seal assembly comprises, in the order of leakage flow from a case drain region (63), a high pressure shaft seal (77), an annular chamber (71) in which is disposed a rigid back-up member (79;91) for the seal (77), a drain passage (81) communicating from the annular chamber (71) to a case drain port (47), and a low pressure shaft seal (83). The back-up member (79;91) may cooperate with either the housing (31) or the seal (77) or the input-output shaft (49) to define a fluid passage (87,89;93,95), so that any leakage flow past the high pressure shaft seal (77) flows through the drain.

8 Claims, 3 Drawing Sheets

VENTED HIGH PRESSURE SHAFT SEAL

CROSS-REFERENCE TO RELATED APPLICATIONS

This application is a continuation-in-part (CIP) of application U.S. Ser. No. 10/167,218, filed Jun. 11, 2003 now abandoned, in the name of James M. LeClair, Jr., Jarett D. Millar and Andrew T. Miller for a "VENTED HIGH PRESSURE SHAFT SEAL".

BACKGROUND OF THE DISCLOSURE

The present invention relates to rotary fluid pressure devices, such as low-speed, high-torque (LSHT) gerotor motors, and more particularly, to an improved high pressure shaft seal assembly for use in such devices.

Gerotor motors of the LSHT type are normally classified, in regard to their valving configuration, as being of either the "spool valve" or "disc valve" type. As used herein, the term "spool valve" refers to a generally cylindrical valve member in which the valving action occurs between the cylindrical outer surface of the spool valve and the adjacent internal cylindrical surface (bore) of the surrounding housing. By way of contrast, the term "disc valve" refers to a valve member which is generally disc-shaped, and the valving action occurs between a transverse surface (perpendicular to the axis of rotation) of the disc valve and an adjacent transverse surface of the housing (stationary valve surface). Furthermore, among disc valve motors, there is also a sub-category which may be referred to as "valve-in-star" motors, in which the gerotor star member itself has a disc valve integral therewith, an example of such a motor being illustrated and described in U.S. Pat. No. 4,741,681, assigned to the assignee of the present invention, and incorporated herein by reference.

Although the present invention may be utilized with LSHT gerotor motors having any one of a number of different valving configurations, it is especially suited for use with spool valve motors, and will be described in connection therewith. It should be noted that the use of spool valve gerotor motors has typically been limited to relatively smaller motors, having relatively lower flow and pressure ratings. This has been true partly because of certain inherent limitations in spool valve motors, resulting from the radial clearance between the spool valve and the adjacent cylindrical surface ("stationary valve surface") of the housing. This radial clearance provides a potential cross port leakage path such that, as the radial dimension of the clearance increases, the volumetric efficiency (and overall efficiency) of the motor decreases.

One of the problems associated with spool valve type gerotor motors is that, as customers seek to continually increase the torque output of the motor by increasing inlet pressure, there is a tendency for the spool valve to "collapse" under the higher pressure, thus increasing the radial clearance between the spool valve surface and the stationary valve surface of the housing. As noted previously, the increasing radial clearance results in decreasing volumetric efficiency of the motor, which is always undesirable from the viewpoint of the customer.

It has been known to those skilled in the art that one possible solution to the problem of a "collapsing" spool valve is to increase the "case drain" pressure, i.e., the pressure in a chamber disposed within the interior of the motor, including the volume disposed within the hollow cylindrical spool valve. The typical way of increasing case drain pressure is simply to restrict flow out of the case drain port, thereby causing a buildup in pressure within the case drain region. Therefore, instead of the case drain region pressure being at reservoir pressure, the case drain region pressure may be elevated to somewhere in the range of 1,000 psi to 2,000 psi., with that pressure opposing the tendency of the spool valve to collapse. As is well known to those skilled in the art, if flow out of the case drain region is restricted, the pressure in the case drain region will typically be about mid-way (or slightly greater) between the inlet pressure and the outlet pressure.

Unfortunately, increasing case drain pressure has not been considered an acceptable solution to the collapsing spool problem because the shaft seal assembly (i.e., the seal between the housing and the rotating output shaft) becomes worn much faster than would otherwise be the case, thus necessitating much more frequent downtime of the motor for replacement of the shaft seal assembly. More frequent replacement of motor shaft seals, and the associated downtime for the motor, is also not acceptable from the viewpoint of the customer.

BRIEF SUMMARY OF THE INVENTION

Accordingly, it is an object of the present invention to provide an improved motor which may operate at increased case pressures without causing faster wear of the shaft seal assembly, thus necessitating more frequent replacement of the shaft seal assembly.

It is a more specific object of the present invention to provide an improved low-speed, high-torque gerotor motor, having an improved shaft seal assembly, whereby the volumetric efficiency of the motor may be increased, especially at relatively higher inlet pressures, while at the same time achieving increased life of the shaft seal assembly.

It is an even more specific object of the present invention to provide an improved gerotor motor of the spool valve type in which the volumetric efficiency of the motor may be increased substantially by operating with increased case pressure, without also increasing the rate of wear of the shaft seal, and the frequency of replacement thereof.

The above and other objects of the present invention are accomplished by the provision of an improved rotary fluid pressure device of the type including housing means having a fluid inlet port and a fluid outlet port. A fluid pressure operated displacement mechanism is associated with the housing means and defines a plurality of expanding and contracting fluid volume chambers in response to movement of a moveable member of the displacement means. A valve member cooperates with the housing means to provide fluid communication between the inlet port and the expanding volume chambers and between the contracting volume chambers in the outlet port. An input-output shaft is rotatably supported relative to the housing means and a drive means for transmitting rotational movement between the input-output shaft and the moveable member of the displacement means is included. A seal assembly is disposed radially between the input-output shaft and the housing means, and cooperates therewith to define a pressurized case drain region.

The improved rotary fluid pressure device is characterized by the seal assembly comprising, in the order of the direction of leakage flow from the pressurized case drain region, a high pressure shaft seal, and then an annular chamber in which is disposed a rigid back-up member disposed adjacent the high pressure shaft seal, the back-up member cooperating with one of the housing means and the high pressure shaft seal and the input-output shaft to define fluid passage means. A drain passage is disposed between the annular chamber and a case drain port, whereby fluid leaking from the case drain region past the high pressure shaft seal flows through the fluid passage means, then through the drain passage to the case drain port. Finally, the seal assembly comprises a low pressure shaft seal.

DETAILED DESCRIPTION OF THE PREFERRED EMBODIMENT

Figure 1:
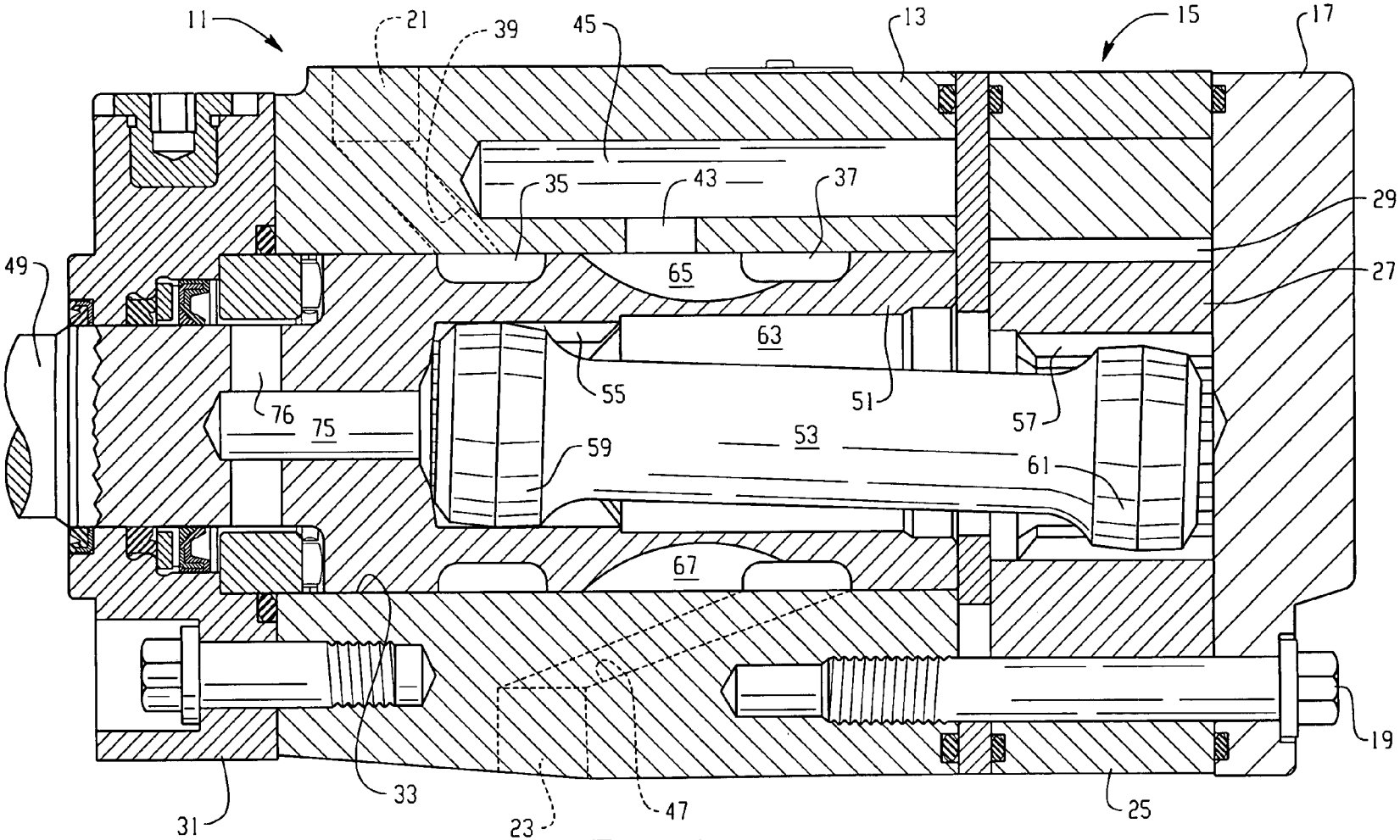
FIG. 1 is an axial cross-section of a gerotor motor of the spool valve type, with which the present invention may be utilized.

Referring now to the drawings, which are not intended to limit the invention, FIG. 1 illustrates an axial cross-section of a rotary fluid pressure device of the type to which the present invention may be applied. More specifically, FIG. 1 illustrates a low-speed, high-torque gerotor motor of the spool valve type, generally designated 11, which comprises several distinct sections. The motor 11 comprises a valve housing 13, a fluid energy-translating displacement mechanism, generally designated 15, which, in the subject embodiment, is a roller gerotor gear set. Disposed adjacent the gear set 15 is an end cap 17, and the housing section 13, the gear set 15, and the end cap 17 are held together in fluid sealing engagement by a plurality of bolts 19, only one of which is shown in FIG. 1. The valve housing section 13 includes a fluid inlet port 21 and a fluid outlet port 23. the gerotor gear set 15 includes an internally-toothed ring member 25, having internal teeth typically comprising rollers. The gear set 15 also includes an externally toothed star member 27, and the internal teeth of the ring member 25 and the external teeth of the star member 27 inter-engage to define a plurality of expanding and contracting fluid volume chambers 29, as is well know to those skilled in the art.

The valve housing 13 includes a forward flange member 31, which will be described in greater detail subsequently. The valve housing 13 defines a spool bore 33, and a pair of annular grooves 35 and 37 are defined by the spool valve, which will be described in greater detail subsequently. The groove 35 is in fluid communication with the inlet port 21 by means of a passage 39, while the annular groove 37 is in fluid communication with the outlet port 23 by means of a passage 41. The valve housing 13 also defines a plurality of radial openings 43, each of which opens to the spool bore 33, and each opening 43 is in fluid communication with an axial passage 45, which communicates to a rear surface of the valve housing 13, each of the axial passages 45 opening into one of the expanding and contracting fluid volume chambers 29.

The forward flange member 31 defines a case drain port 47, shown herein as being plugged, the function of the case drain port 47 to be described in greater detail subsequently. Disposed within the spool bore 33 is an output shaft assembly, including an input-output shaft portion 49, and a spool valve portion 51. Disposed within the hollow, cylindrical spool valve portion 51 is a main drive shaft 53 commonly referred to as a "dogbone" shaft. The output shaft assembly defines a set of straight internal splines 55, and the star member 27 defines a set of straight internal splines 57. The main drive shaft 53 includes a set of external crowned splines 59 in engagement with the internal splines 55, and a set of external crowned splines 61 in engagement with the internal splines 57.

As may best be seen in FIG. 1, the spool valve portion 51 and the main drive shaft 53 cooperate to define a case drain region 63, as is generally well know to those skilled in the art. The spool valve portion 51 defines a plurality of axial passages 65 in communication with the annular groove 35, and a plurality of axial passages 67 in communication with the annular groove 37. The axial passages 65 and 67 are also frequently referred to as "timing slots". As is generally well know to those skilled in the art, it is the timing slots 65 which provide fluid communication of pressurized fluid from the pressurized inlet port 21 through the annular groove 35 to the radial openings 43, and from there, to the fluid volume chambers 29 which are, instantaneously, expanding. As is also well know to those skilled in the art, there are a plurality of the axial passages 65 and a plurality of the axial passages 67, and the passages 65 and 67 are arranged to alternate about the circumference of the spool valve portion 51 such that, regardless of which port 21 or 23 contains high pressure, the spool valve portion 51 will have high pressure fluid acting on it, about its circumference, tending to collapse the spool valve portion 51, as was mentioned in the BACKGROUND OF THE DISCLOSURE.

The port 21 has been referenced herein as the "inlet port", in which case, the rotation of the output shaft portion 49 would be in the CC (clockwise) direction. However, as is well known, if the port 23 would be pressurized, and serve as the inlet port, the rotation of the output shaft portion 49 would be in the CCW (counter-clockwise) direction. In the subject embodiment, it is when the port 23 is the inlet port, and the annular groove 37 contains pressurized fluid, that the problem of high pressure spool collapse is relatively more severe. Those skilled in the art will understand that, as used herein, the term "collapse", in reference the to spool valve portion 51, means a decrease in the radius of the spool valve portion, and typically, that decrease would be in the range of about 0.0005 inches (0.0127 mm) to about 0.001 inches (0.0254 mm), resulting in an increase in diametral clearance of about 0.001 inches (0.0254 mm) to about 0.002 inches (0.0508 mm). As a result, test data presented hereinafter will all be based upon operation of the motor in the CCW direction.

Figure 2:
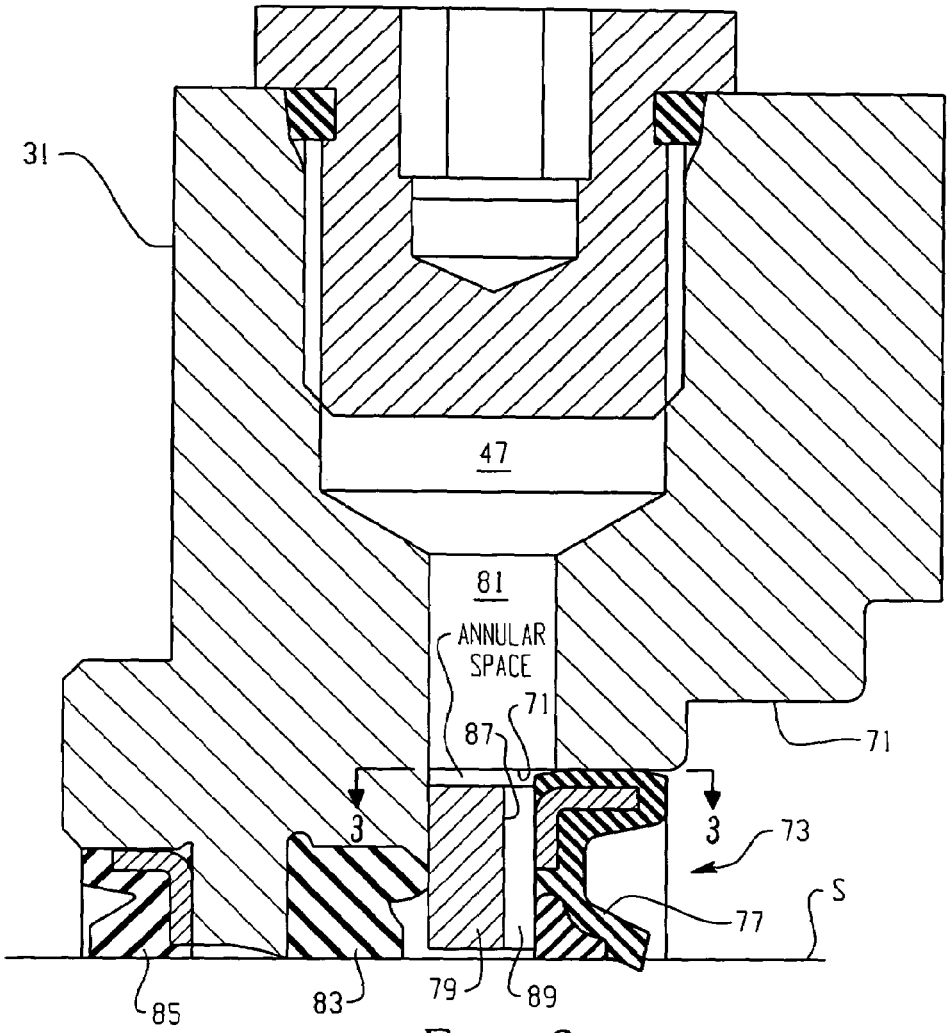
FIG. 2 is an enlarged, fragmentary, axial cross-section, similar to FIG. 1, but taken on a different plane, illustrating the improved high pressure shaft seal assembly of the present invention.

Referring now primarily to FIG. 2, the forward flange member 31 defines a stepped bore 71 surrounding the input-output shaft portion 49, the outer surface of which is represented schematically in FIG. 2 by the line labeled "S". Disposed within the stepped bore 71 is a high pressure shaft seal assembly, generally designated 73, which comprises an important aspect of the present invention. As is well known, and typical in the prior art, the input-output shaft portion 49 defines an axial fluid passage 75 and one or more radial fluid passages 76 through which fluid may flow from the case drain region 63 to an area adjacent the shaft seal assembly 73. The shaft seal assembly 73 comprises, in the order of the direction of leakage flow from the case drain region 63 (i.e., from right to left in FIG. 2), a high pressure shaft seal 77, an annular washer 79 which serves as a backup ring to the high pressure shaft seal 77, and a drain passage 81 providing fluid communication from the stepped bore 71 to the case drain port 47, as will be described in greater detail subsequently. Finally, the shaft seal assembly 73 includes a conventional, low pressure shaft seal 83. In addition, although not considered part of the high pressure shaft seal assembly 73, there is preferably a dust seal 85, disposed adjacent a forward surface of the flange member 31. As is well know to those skilled in the art, the primary function of the dust seal 85 is to prevent ingress of dust and dirt from the exterior of the motor, moving to the right in FIG. 1 or 2 along the outer surface of the shaft portion 49 and entering the internal portion of the motor 11.

Referring still primarily to FIG. 2, the high pressure shaft seal 77 preferably comprises a high pressure lip seal or quad seal or any other of the typically utilized high pressure seals. As used herein, and in the appended claims, references to a "high pressure" seal, such as the seal 77 will be understood to mean and include a seal member capable of sealing pressures of at least about 1,500 psi, and preferably as much as 3000 psi or more. The elastomeric portion of the high pressure shaft seal 77 would typically have a durometer which is somewhat higher than would be used for a conventional low pressure seal, such as the low pressure shaft seal 83. Also, it would be typical for the lip of the high pressure shaft seal 77 to have a greater amount of interference with the adjacent surface of the shaft portion 49 than would a typical low pressure shaft seal. Although the high pressure shaft seal 77 has been referred to herein as "elastomeric", it should be understood that that term is being used broadly and generically, and the seal 77 could comprise a material such as polytetrafluoroethylene.

Figure 3:
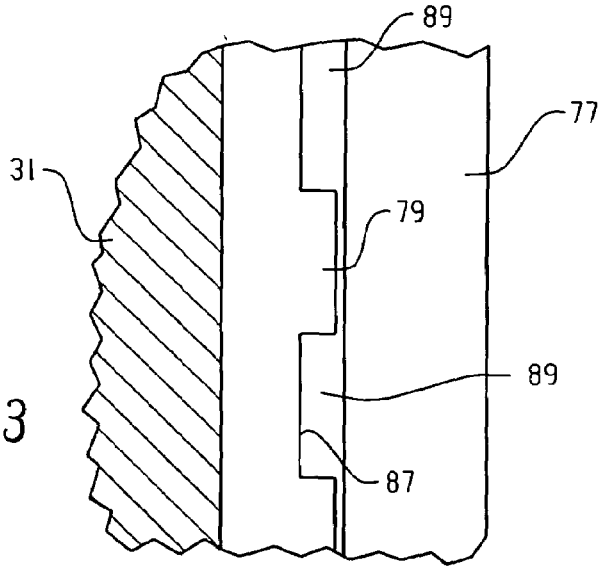
FIG. 3 is a further enlarged, laid out, plan view, taken on line 3—3 of FIG. 2 and illustrating the radial fluid passages which comprise one important aspect of the invention.

Referring now primarily to FIG. 3, it may be seen that the annular washer 79 preferably defines a series of circumferentially spaced apart notches 87. In the subject embodiment, and by way of example only, each of the notches 87 has an axial depth of about 0.050 inches (1.27 mm). However, all that is important in regard to the selection of the configuration of the notches 87 is that they be large enough so that, when there is leakage flow past the high pressure shaft seal 77, there will not be any substantial build-up of pressure in the region surrounding the shaft portion 49, between the high pressure shaft seal 77 and the low pressure shaft seal 83. In other words, there should be minimum pressure differential from the notches 87 to the case drain port 47. Preferably, the annular washer 79 has an inside diameter somewhat greater than that of the shaft portion 49, so that the annular washer 79 is loosely disposed about the input-output shaft portion 49, and able to move somewhat in the radial direction, relative thereto.

During operation of the motor 11, the case drain region 63 receives pressurized fluid primarily as a result of leakage from the pressurized, expanding fluid volume chambers 29, radially inward along the end faces of the star member 27, as is well known in the art. A portion of the leakage fluid entering the case drain region 63, as just described, flows through the fluid passages 75 and 76, and acts against the high pressure shaft seal assembly 73. During the early hours of operation of the motor 11, it is anticipated that the high pressure shaft seal 77 would not permit any substantial leakage flow past the seal 77 (i.e., between the lip of the seal 77 and the surface of the shaft portion 49). Depending upon factors such as the fluid pressure, the speed of operation of the motor, etc., the initial period during which there is no substantial leakage past the high pressure shaft seal 77 may last anywhere from about 20 hours (of motor operation) to about 200 hours.

With no substantial leakage flow past the high pressure shaft seal 77, the pressure in the case drain region 63 will be relatively high, as described previously, thus opposing the tendency of the spool valve portion 51 to collapse. In accordance with an important aspect of the invention, after the initial period of no substantial leakage, as described above, the high pressure shaft seal 77 will finally begin to leak somewhat. The notches 87 and the high pressure shaft seal 77 cooperate to define a plurality of small orifices 89, through which leakage fluid must flow, after getting past the high pressure shaft seal 77. The size of the orifices 89 insures that there is almost no build-up of pressure within the shaft seal assembly 73, as was described previously. Although the present invention has been illustrated in connection with an embodiment in which the orifices 89 are formed between the notches and the seal 77, it should be understood that the invention is not so limited. By way of example only, the annular washer 79 could be installed reversed from what is shown in FIGS. 2 and 3, such that the notches 87 face forward (i.e., to the right in FIGS. 2 and 3). In that case the orifices 89 would be formed by the notches 87 and an adjacent surface of the flange member 31. As another alternative, the orifices 89 could be formed by drilling (or otherwise forming) radial holes through the annular washer 79.

In order to illustrate the substantial improvement resulting from the present invention, comparative testing was performed, under conditions to be described in greater detail subsequently. In the comparative testing, a "prior art" motor was compared to a motor made in accordance with the "invention" (see table below).

Each comparison was performed at either 4 gpm or 8 gpm flow through the motor. In each test, a "back pressure" was imposed on the motor at the outlet port, the back pressures being selected as 500 psi; 1000 psi; or 1500 psi.

For each back pressure and flow rate, the testing was performed at three different "delta pressures", i.e., referring to the difference between the inlet port pressure and the outlet port pressure. Therefore, by way of example, when the back pressure is 1000 psi and the delta pressure is 1500 psi, the pressure at the inlet port is 2500 psi and the pressure at the outlet port is 1000 psi.

In the comparison, the numbers presented under the "Prior Art" and "Invention" columns are overall efficiencies. As is well know to those skilled in the art, the overall efficiency is merely the product of the volumetric efficiency and the mechanical efficiency (if M.E.=70% and V.E.=80%, then O.E.=56%), and overall efficiency is considered to be the most valid basis for comparison.

In performing the comparative testing, the comparison was between a "prior art" device comprising a spool valve motor of the general type sold commercially by the assignee of the present invention, in which the case drain region is in relatively unrestricted communication with the case drain port, such that the fluid pressure within the case drain region is relatively low (e.g., 50 to 100 psi). By comparison, the "invention" is substantially the identical motor, but modified in accordance with the present invention (i.e., by the use of the forward flange member 31 and the high pressure shaft seal assembly 73). With the invention, the case drain pressure is maintained at about 50% or 60% of the difference between the outlet port pressure and the inlet port pressure. Therefore, by way of example, if the outlet port pressure (back pressure) is 1000 psi, and the delta pressure is 1500 psi, the case drain pressure would be about 1750 to about 1900 psi.

Data Table

| Flow (gpm) | Back Press (psi) | Delta Press (psid) | Prior Art | Invention |
|---|---|---|---|---|
| 4 | 500 | 500 | 56 | 59 |
| 4 | 500 | 1000 | 42 | 61 |
| 4 | 500 | 1500 | 0 | 56 |
| 8 | 500 | 500 | 58 | 51 |
| 8 | 500 | 1000 | 60 | 65 |
| 8 | 500 | 1500 | 50 | 65 |
| 4 | 1000 | 500 | 39 | 59 |
| 4 | 1000 | 1000 | 3 | 61 |
| 4 | 1000 | 1500 | 0 | 56 |
| 8 | 1000 | 500 | 58 | 51 |
| 8 | 1000 | 1000 | 60 | 65 |
| 8 | 1000 | 1500 | 50 | 65 |
| 4 | 1500 | 500 | 19 | 54 |
| 4 | 1500 | 1000 | 0 | 54 |
| 4 | 1500 | 1500 | 0 | 43 |
| 8 | 1500 | 500 | 46 | 51 |
| 8 | 1500 | 1000 | 43 | 61 |
| 8 | 1500 | 1500 | 17 | 58 |

From a review of the above data it may be seen that, with increasing back pressure and increasing delta pressure, the extent of the improvement of the device of the invention over the device of the prior art increases substantially, but it should also be noted that the increase is typically greater at the relatively lower flow rate (4 gpm) as opposed to the relatively higher flow rate (8 gpm). Thus, it may be seen that the present invention permits the application of motors of this type at higher back pressures and higher delta pressures, while still maintaining acceptable overall efficiencies.

Figure 4:
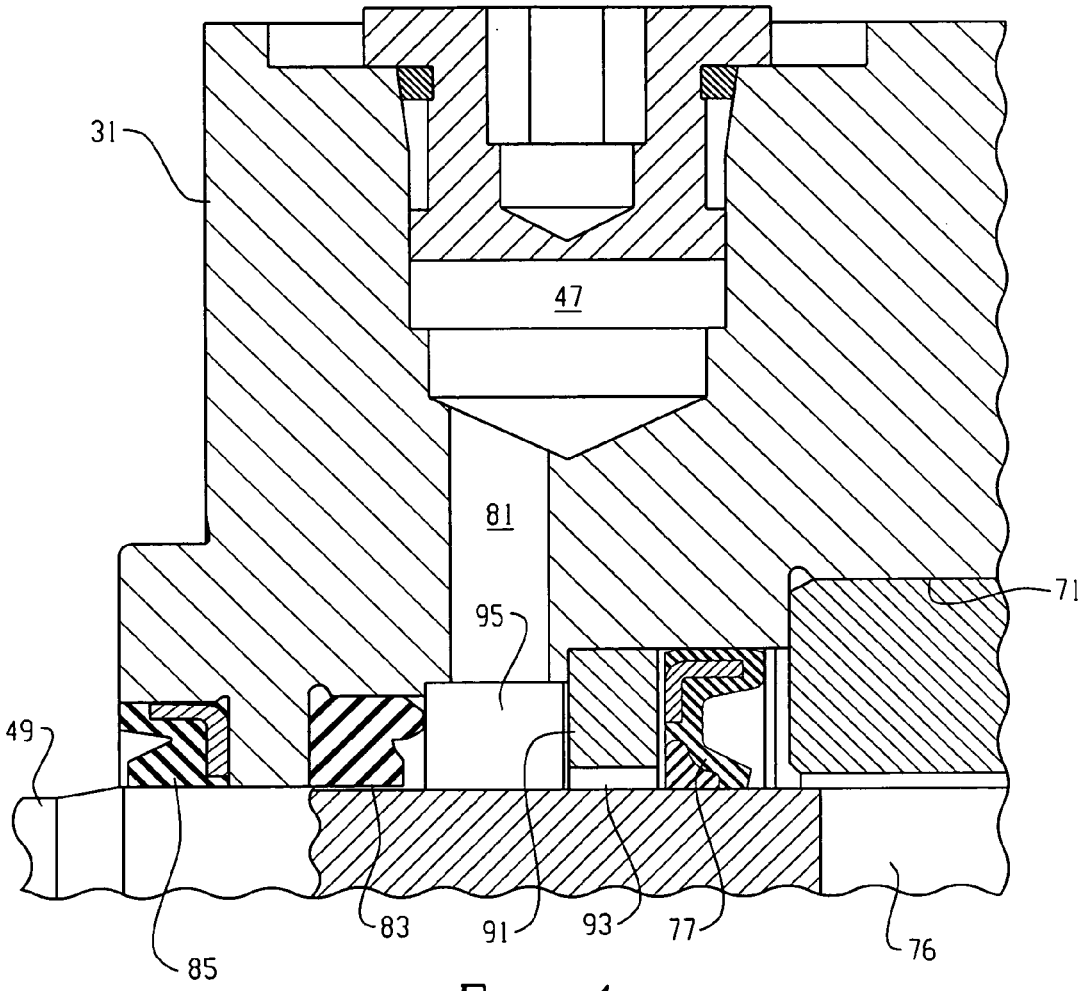
FIG. 4 is an enlarged, laid out plan view, similar to FIG. 3, but illustrating an alternative embodiment of the present invention.

Referring now primarily to FIG. 4, in which there is illustrated an alternative embodiment of the invention, it may be seen that like elements bear like numerals, with new or substantially different elements bearing reference numerals in excess of "90". Therefore, in the embodiment of FIG. 4, in which the drain passage 81 is disposed further toward the front (left end in FIG. 4) of the motor than in the FIG. 2 embodiment, the other differences from the main embodiment will now be described. In the FIG. 4 embodiment, there is provided an annular washer or backup ring 91, which is seated against a shoulder formed by the forward flange member 31, to the right of the drain passage 81. The backup ring 91 cooperates with the outer diametral surface of the input-output shaft portion 49 to define one or more axially-extending fluid passages 93, which may comprise a series of notches as in the main embodiment, or may merely comprise an annular space.

Disposed to the left (in FIG. 4) of the backup ring 91, the forward flange member 31 defines an annular groove 95, which serves as a radial fluid passage to communicate fluid which leaks past the high pressure seal 77, from the axially-extending fluid passages 93 to the drain passage 81. Thus, the embodiment of FIG. 4 operates in effectively the same manner as the main embodiment, except that in the FIG. 4 embodiment, there is axial flow through the passages 93 before the radial flow through the notches 87 (or through the radial fluid passage 95).

One advantage of the FIG. 4 embodiment is that the high pressure shaft seal 77 is supported, over its entire circumferential extent, by the backup ring 91, whereas in the main embodiment, a very high pressure can deflect portions of the seal 77 into the notches 87. In some configurations, such deflection of the shaft seal 77 could result in gaps, for example, between the outer periphery of the seal and an adjacent housing surface, thus permitting leakage past the seal 77. It has been observed that such deflection is substantially prevented by the configuration of the FIG. 4 embodiment.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A rotary fluid pressure device of the type including housing means having a fluid inlet port and a fluid outlet port; a fluid pressure-operated displacement means associated with said housing means, and defining a plurality of expanding and contracting fluid volume chambers in response to movement of a moveable member of said displacement means; a valve member cooperating with said housing means to provide fluid communication between said inlet port and said expanding volume chambers, and between said contracting volume chambers and said outlet port; an input-output shaft rotatably supported relative to said housing means and drive means for transmitting rotational movement between said input-output shaft and said moveable member of said displacement means; a seal assembly disposed radially between said input-output shaft and said housing means, and cooperating therewith to define a pressurized case drain region; characterized by said seal assembly comprising, in the order of the direction of leakage flow from said pressurized case drain region;

(a) a high pressure shaft seal;

(b) an annular chamber in which is disposed a rigid back-up member disposed adjacent said high pressure shaft seal, said back-up member directly cooperating with a member selected from the group consisting of said housing means, said high pressure shaft seal and said input-output shaft to define fluid passage means;

(c) a drain passage disposed between said annular chamber and a case drain port, whereby fluid leaking from said case drain region past said high pressure shaft seal flows through said fluid passage means, then through said drain passage to said case drain port; and (d) a low pressure shaft seal.

2. A rotary fluid pressure device as claimed in claim 1, characterized by said rigid back-up member comprising an annular metal member defining a plurality of radially-extending notches, said notches comprising said fluid passage means.

3. A rotary fluid pressure device as claimed in claim 2, characterized by said notches being disposed immediately adjacent said high pressure shaft seal, said radially-extending notches and said seal cooperating to define said fluid passage means.

4. A rotary fluid pressure device as claimed in claim 1, characterized by said high pressure shaft seal being selected such that no substantial leakage flow is permitted by said high pressure shaft seal, from said case drain region to said drain passage during an initial time period T1, thus maintaining a pressure in said case drain region which comprises at least about one-half of the pressure in said inlet port.

5. A rotary fluid pressure device as claimed in claim 1, characterized by said fluid pressure-operated displacement means comprises an internally-toothed ring member and an externally-toothed star member, which comprises said moveable member, said star member being disposed eccentrically within said ring member for relative orbital and rotational movement.

6. A rotary fluid pressure device as claimed in claim 1, characterized by said valve member comprising a hollow, generally cylindrical spool valve member, wherein the fluid pressure present in said inlet port surrounds said spool valve member over at least a limited axial extent thereof, and said case drain region being disposed at least partially within said spool valve member.

7. A rotary fluid pressure device as claimed in claim 1, characterized by said back-up member directly cooperating with said input-output shaft to define axially-extending fluid passage means.

8. A rotary fluid pressure device as claimed in claim 7, characterized by said back-up member directly cooperating with said housing means and said input-output shaft to define radially-extending fluid passage means providing fluid communication from said axially-extending fluid passage means to said drain passage.

* * * * *